US005163508A

United States Patent [19]

Hamos

[11] Patent Number: 5,163,508

[45] Date of Patent: Nov. 17, 1992

[54] HEAT EXCHANGER BAFFLE SYSTEM

[75] Inventor: Robert E. Hamos, Simi Valley, Calif.

[73] Assignee: Teledyne Industries, Inc., Los Angeles, Calif.

[21] Appl. No.: 868,193

[22] Filed: Apr. 14, 1992

Related U.S. Application Data

[63] Continuation-in-part of Ser. No. 807,207, Dec. 16, 1991.

[51] Int. Cl.[5] ..... F28F 9/22

[52] U.S. Cl. ..... 165/159; 165/160; 165/181; 165/903

[58] Field of Search ..... 165/903, 181, 159, 160; 123/41.58, 41.61

[56] References Cited

U.S. PATENT DOCUMENTS

| | | | |
|---|---|---|---|
| 2,031,541 | 2/1936 | MacClain | 123/41.61 |
| 2,330,065 | 9/1943 | Lucke | 123/41.61 |
| 2,340,855 | 2/1944 | Abrams | 123/41.61 |
| 3,421,482 | 1/1969 | Ortega | 126/307 A |
| 3,616,849 | 11/1971 | Dijt | 165/159 |
| 3,623,458 | 11/1971 | Block | 126/307 R |
| 3,800,748 | 4/1974 | Schindler | 126/307 R |
| 4,721,068 | 1/1988 | Rheinfelder et al. | 165/181 |
| 4,732,585 | 3/1988 | Lerner | 165/159 |
| 4,957,160 | 9/1990 | Raleigh | 165/160 |

FOREIGN PATENT DOCUMENTS

| | | | |
|---|---|---|---|
| 332957 | 12/1935 | Italy | 123/41.61 |
| 850532 | 10/1960 | United Kingdom | 165/903 |

*Primary Examiner*—John Rivell
*Assistant Examiner*—L. R. Leo
*Attorney, Agent, or Firm*—Benoit Law Corporation

[57] ABSTRACT

A plurality of baffles for adjacent finned tubes of a heat exchanger wherein a first fluid flows in the finned tubes and a second fluid of a different temperature flows past the finned tubes in heat transfer relationship therewith, include a baffle for each adjacent pair of finned tubes. A first flow path for second fluid extends in between baffles at one of the finned tubes, and a second flow path for second fluid extends in between baffles at an adjacent other of the finned tubes. The second flow path is larger between baffles at the other finned tube than the first flow path between baffles at the one finned tubes, and the second flow path is longer along baffles at the other finned tube than the first flow path along baffles at the one finned tube.

20 Claims, 2 Drawing Sheets

HEAT EXCHANGER BAFFLE SYSTEM

CROSS-REFERENCE

This is a continuation-in-part of patent application 07/807,207, filed Dec. 16, 1991, by Robert E. Hamos, for Wind Resistant Heating Appliance, assigned to the common assignee, and herewith incorporated by reference herein.

BACKGROUND OF THE INVENTION

It is well known that hot gas past a plain tube with water inside gives a certain amount of heat transfer.

By putting fins on the tube the surface area is increased and thereby the heat transfer is increased.

By putting baffles on top of the fins, the gas velocity is slowed, and the contact time is increased thereby giving even more heat transfer.

There has been a need to increase the heat transfer even further than was heretofore possible.

SUMMARY OF THE INVENTION

It is a general object of this invention to provide improved baffle structures.

It is a germane object of this invention to provide improved baffles.

It is a related object of this invention to provide improved unitary structures of heat exchangers with baffles located therein.

Other objects will become apparent in the further course of this disclosure.

The invention resides in a method of providing a plurality of baffles for adjacent finned tubes of a heat exchanger wherein a first fluid flows in the finned tubes and a second fluid of a different temperature flows past the finned tubes in heat transfer relationship therewith, comprising, in combination, the steps of providing a baffle for each adjacent pair of finned tubes, providing a first flow path for second fluid in between baffles at one of the finned tubes, providing a second flow path for second fluid in between baffles at an adjacent other of the finned tubes, making that second flow path larger between baffles at the other finned tube than the first flow path between baffles at the one finned tube, and making the second flow path longer along baffles at the other finned tube than the first flow path along baffles at the one finned tube.

The invention resides also in methods and apparatus for providing a baffle for an adjacent pair of elongate finned tubes of a heat exchanger, wherein each of the tubes has an annular heat-exchange fin structure thereabout, wherein the baffle is provided with or has two elongate sections at an obtuse angle for accommodating one of the heat-exchange fin structures, and a third elongate section at an acute angle to one of the two elongate sections for accommodating the heat-exchange fin structures of both of said pair of elongate finned tubes at that acute angle.

The invention resides moreover in a heat exchanger including a plurality of adjacent finned tubes, wherein a first fluid flows in the finned tubes and a second fluid of a different temperature flows past the finned tubes in heat transfer relationship therewith, comprising, in combination, a baffle for each adjacent pair of finned tubes, a first flow path for second fluid in between baffles at one of the finned tubes, and a second flow path for second fluid in between baffles at an adjacent other of the finned tubes, that second flow path being larger between baffles at the other finned tube than the first flow path between baffles at the one finned tube, and the second flow path being longer along baffles at the other finned tube than the first flow path along baffles at the one finned tube.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
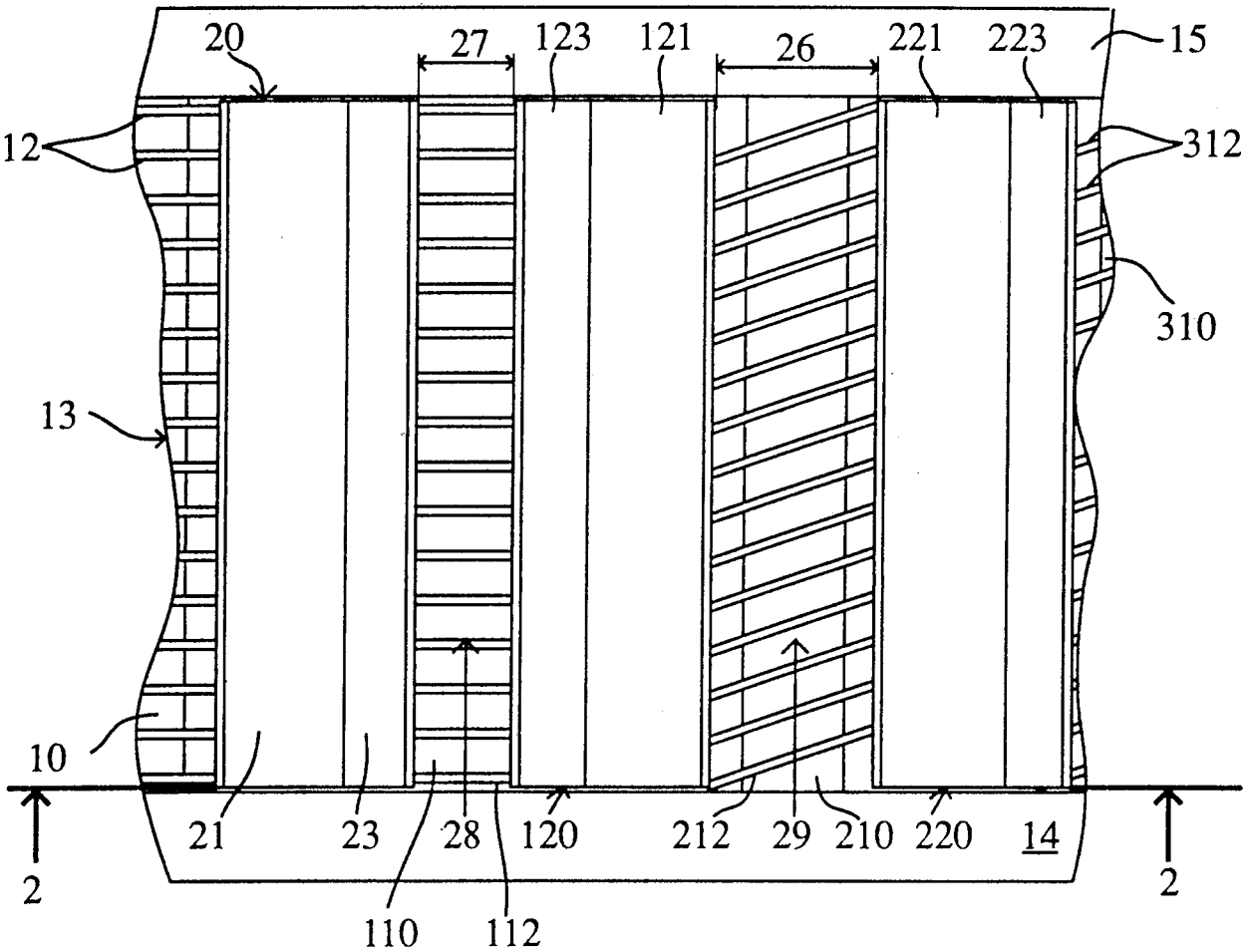
FIG. 1 is a top view of part of a heat exchanger with baffle structure according to an embodiment of the invention.
Figure 2:
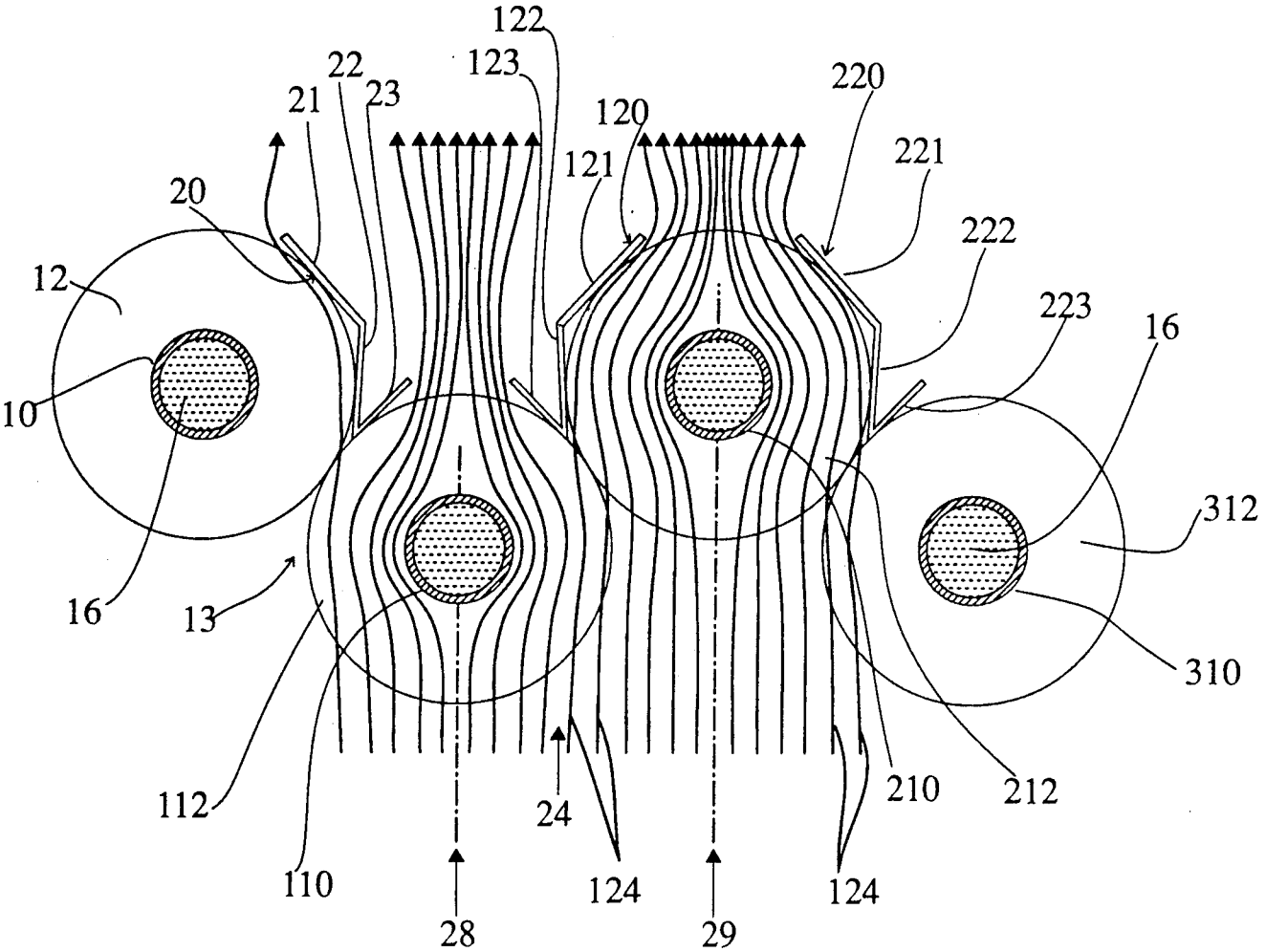
FIG. 2 is a section taken on the line 2—2 in FIG. 1.

A baffle structure according to a preferred embodiment of the invention is shown in FIGS. 1 and 2 with the aid of a few representative heat exchanger tubes 10, 110, 210, and 310 having heat dissipation fins 12, 112, 212 and 312 extending therearound, either coiled as shown for the fins 212 and 312 in FIG. 2, or in parallel circular plates or annuli as shown for the fins 12 and 212, for example. Those skilled in the art will realize that FIG. 1, in order to avoid crowding, shows the spacing between these fins larger and the slant of fins 212 and 312 steeper than what may be typical in heat exchangers.

The following patents are incorporated by reference herein to show examples of apparatus and appliances in which baffles according to the subject invention may be used:

- U.S. Pat. No. 4,957,160, by William F. Raleigh, issued Sep. 18, 1990 for a Self-Clamping Baffle for Tubular Structures, such as finned heat exchanger tubes.
- U.S. Pat. No. 4,893,609, by Giordani et al., issued Jan. 16, 1990 for Wind-Resistant Outdoor Heating Appliance and showing a heat exchanger with heat exchanger tubes staggered similar to tubes 10, 110, 210 and 310 as shown in FIG. 2.
- U.S. Pat. No. 4,501,232, by Gordbegli et al., issued Feb. 26, 1985 for Pool or Spa Water Heater, showing another heat exchanger with finned tubes.
- U.S. Pat. No. 3,800,748, by Schindler et al., issued Apr. 2, 1974, and showing still another Fluid Heater Appliance with finned heat exchanger tubes.
- U.S. Pat. No. 3,797,477, by Robert M. Ramey, issued Mar. 19, 1974 for Convertible Gas Heating Apparatus in which the fin and baffle structure according to the subject invention can be used in lieu of the heat exchanger pipe structure therein disclosed.
- U.S. Pat. No. 3,623,458, by Leo Block, issued Nov. 30, 1971 for a Stackless Outdoor Heater Adapted for Swimming Pools in which the fin and baffle structure according to the subject invention can be used in lieu of the heat exchanger pipe structure therein disclosed.
- U.S. Pat. No. 3,536,060, also by Leo Block, issued Oct. 27, 1970 for a Draft Hood, and showing a boiler or furnace construction in which the fin and baffle structure according to the subject invention can be used in lieu of the heat exchanger.

U.S. Pat. No. 3,421,482, by R. Ortega, issued Jan. 14, 1969 for an Outdoor Swimming Pool Heater in which the fin and baffle structure according to the subject invention can be used in lieu of the heat exchanger pipe structure therein disclosed.

U.S. Pat. No. 3,292,598, by Avy L. Miller and Robert M. Ramey, issued Dec. 20, 1966 for a Water Heater including a heat exchanger with internal water bypass.

In similarity to heat exchangers shown in these incorporated references, the heat exchanger 13 shown in the accompanying drawings has its finned tubes, including staggered tubes 10, 110, 210 and 310 extending between and connected to two spaced headers 14 and 15 in a typically conventional flow circuit for liquid or fluid 16 to be heated or cooled by or in the heat exchanger 13.

In this respect, known heat exchangers let the liquid or fluid flow in series through the finned tubes, in parallel, or more typically in series through parallel groups of heat exchanger tubes, such as tubes 10, 110, 210 and 310, for example. Reference may in this respect be had to the above mentioned incorporated Miller and Ramey U.S. Pat. No. 3,292,598.

The accompanying drawings in particular show a method of providing baffles, or show a baffle structure, for an adjacent pair of elongate finned tubes 10 and 110 of a heat exchanger 13, wherein each of these tubes has an annular heat-exchange fin structure 12 or 112 thereabout.

A baffle 20 has or is provided with two elongate sections 21 and 22 extending at an obtuse angle to each other for accommodating, or so as to accommodate, one of the heat-exchange fin structures, such as the fin structure 12. That baffle 20 also has or is provided with a third elongate section 23 at an acute angle to one of the two elongate sections, such as the section 22, for accommodating, or so as to accommodate, both of the heat-exchange fin structures 12 and 112 at that acute angle.

The baffle 20 has utility by itself, but the full benefit thereof typically is attained in conjunction with other baffles.

In this respect, the drawings show a third elongate finned tube 210 having a third annular heat-exchange fin structure 212 thereabout adjacent a first one of the pair of elongate finned tubes 10 and 110, such as adjacent the second elongate finned tube 110 or the second fin structure 112.

A second baffle 120 has or is provided with fourth and fifth elongate sections 121 and 122 extending at an obtuse angle to each other for accommodating, or so as to accommodate, the third heat-exchange fin structure 212.

That second baffle 120 has or is provided with a sixth elongate section 123 extending at an acute angle to the fifth elongate section 122 for accommodating, or so as to accommodate, one of said pair of elongate finned tubes 10 and 110, such as the second elongate finned tube 110 or second fin structure 112, and the third annular heat exchange fin structure 212. The sixth elongate section 123 is spaced from the third elongate section 23, such as shown in the drawings.

A fourth elongate finned tube 310 having a fourth annular heat-exchange fin structure 312 thereabout is adjacent the third elongate finned tube 210 or adjacent the third fin structure 212. A third baffle 220 is provided with seventh and eighth elongate sections 221 and 222 at an obtuse angle for accommodating, or so as to accommodate, the third heat-exchange fin structure 212.

The third baffle has or is provided with a ninth elongate section 223 extending at an acute angle to the eighth elongate section 222 for accommodating, or so as to accommodate, the third and fourth annular heat exchange fin structures 212 and 312.

As seen in FIG. 2, the baffles 20, 120 and 220 extend with their acute apices in between, or into the gap between, adjacent finned tubes or fin structures. FIG. 2 shows the acute apices of baffles 20 and 120, for instance, resting against the fin structure 112.

Within the scope of the invention, each acute baffle apex may, however, be spaced equidistantly from the adjacent fin structures, such as from the fin structures 12 and 112 for the acute apex between sections 22 and 23 of the baffle 20.

The seventh elongate section 221 is spaced from the fourth elongate section 121, such as shown in FIG. 2. According to a preferred embodiment of the invention, that seventh elongate section 221 is spaced from that fourth elongate section 121 more than the sixth elongate section 123 is spaced from the third elongate section 23.

Preferably, the spacing 26 between the obtuse fourth and seventh elongate sections 121 and 221 is some 1.4 to 1.6 times larger than the spacing 27 between the acute third and sixth elongate sections 23 and 123.

The presently conceived best mode prefers the spacing 26 between the vicinal obtuse sections to be one and one-half times the spacing 27 between vicinal acute sections, for optimum fluid flow for the flue products, heating fluid or coolant 24 flowing past the heat exchanger tubes in between the fins.

As indicated in FIG. 2, the baffles according to embodiments of the invention cause the flue product or other heat-exchanging fluid 42 to flow optimally through the finned tube structure, including past the tubes 10-310 and their fin structures 12-312 in optimum heat-transfer relationship therewith.

Accordingly, the water or other heat-exchanged fluid 16 is optimally heated or cooled as the case may be. In this respect, the medium 24 could be a heating medium, as in the case of most of the apparatus of the incorporated patents, or a coolant, as in the case of a cooling or refrigerating unit. Conversely, the fluid 24 could be air or another fluid to be heated or cooled, while the fluid 16 could be a heated medium or coolant.

In this respect and in general, the invention also provides a plurality of baffles 20, 120, 220 for adjacent finned tubes of a heat exchanger wherein a liquid to be heated or another first fluid flows 16 in such finned tubes 10, 110, 210, 310 and flue products or another second fluid of a different temperature flows past these finned tubes in heat transfer relationship therewith. This aspect of the invention provides a baffle 20, 120, and 220 for each adjacent pair of finned tubes 10/110, 110/210, and 210/310, respectively. This aspect of the invention also provides a first flow path 28 for second fluid 24 in between baffles 20 and 120 at one of the finned tubes 110, and provides a second flow path 29 for second fluid 24 in between baffles 120 and 220 at an adjacent other of the finned tubes 210.

As seen from the spacing 26 relative to the spacing 27, the illustrated embodiment makes the second flow path 29 larger between baffles 120 and 220 at said other finned tube 210 than the first flow path 28 between baffles 20 and 120 at said one finned tube 110. As seen for instance from the combined lengths of baffle sections 121 and 122 relative to the length of each of the short baffle sections 23 and 123, the illustrated embodiment makes the second flow path 29 longer along baffles 120 and 220 at said other finned tube than the first flow path along baffles 20 and 120 at said one finned tube 110.

In particular, the illustrated embodiment provides each baffle with a first section 23 or 123 at said one finned tube 110, and with a second section 121, 122 or 221, 222 at said other finned tube 210, with that second section being made longer in the second flow path 29 than the first section 23 or 123 in the first flow path 28. Moreover, second sections 121, 122 or 221, 222 of baffles 120 and 220 at said other finned tube 210 are spaced further apart from each other than first sections 23 and 123 of baffles 20 and 120 at said one finned tube 110.

It may be noted that the expressions "first" and "second" in this context does not necessarily correspond to the terms "first" and "second" given above in a different context. For instance, what has been called above "a third elongate section 23" may now be a "first section 23," while what is now called "a second section 121, 122" may in fact be the above mentioned "fourth and fifth elongate sections 121 and 122" combined. Similarly, what has now been called "a second section 221, 222" for the baffle 220 may in fact be a combination of the above mentioned "seventh and eighth elongate sections 221 and 222" for the baffle 220, and so forth.

In this respect, while each second section 121, 122 and 221, 222 is shown as angled into two elongate sections, each such second section may be comprised of only one section within the scope of the invention, and may be bent if necessary to accommodate its adjacent fin structure 212 or finned tube 210, for instance.

According to the illustrated preferred embodiment of the invention, the finned tubes 10, 110, 210, 310, etc. are staggered with respect to each other, and part of the second flow path 29 extends first along an outer part of the above mentioned one finned tube 110 and hence along the adjacent other finned tube 210.

In this respect and in general, each of the finned tubes has heat-exchange fins 12, 112, 213, 312 extending thereabout and spaced therealong. The first flow path 28 extends in between fins 112 about the one finned tube 110, and the second flow path 29 extends in between fins 212 about the other finned tube 210.

According to the embodiment as illustrated in FIG. 2 with the aid of flow lines 124, part of the second flow path 29 extends also in between fins 112 about the one finned tube 110 which is closer to the burner or heater (e.g. 61 in the incorporated Giordani et al U.S. Pat. No. 4,893,609) than the other finned tube 210, but farther from the exhaust (e.g. 26 in that incorporated Giordani et al patent) than the adjacent other finned tube 210. The second flow path 29 extends hence in between fins 212 about the other finned tube 210 which is farther from the heater than the one finned tube 110, but closer to the exhaust than that one finned tube.

The features of the invention and its embodiments herein disclosed improve the heat exchange function and increase the efficiency of the heat exchanger.

Since the spacing 26 is wider than the spacing 27 as shown in FIG. 1, the second flow path 29 is also wider or larger than the first flow path 28 as shown in FIG. 2. Accordingly, part of the combustion product or other second fluid 24 flows in series in heat-transfer relationship with the first and second finned heat exchanger tubes 110 and 210, or in series in between first fins 112 and second fins 212, such as indicated by flow lines 124 in the middle of FIG. 2.

In addition, the illustrated preferred embodiment lengthens the heat-transfer flow path for the part 124 of the combustion product or other second fluid 24 that flows in series through the first and second finned heat exchanger structure.

The embodiment shown in FIG. 2 does this by making the second flow path 29 or baffle sections 121, 122 and 221, 222 longer than the first flow path 28 or baffle sections 23 and 123.

In this respect, the spacing 26 for the second flow path 29 preferably is some 1.4 to 1.6 times larger than the spacing 27 for the first flow path 28, as already indicated above.

In general, baffles according to the subject invention allow a longer gas/fin path and thereby increase the heat transfer substantially. Within the scope of the invention, the baffle area can be closed further for more residence time, in addition to the longer path, to get even more heat transfer.

The subject extensive disclosure will render apparent or suggest to those skilled in the art various modifications and variations within the spirit and scope of the subject invention and equivalents thereof.

I/We Claim:

1. A method of providing a plurality of baffles for adjacent finned tubes of a heat exchanger wherein a first fluid flows in said finned tubes and a second fluid of a different temperature flows past said finned tubes in heat transfer relationship therewith, comprising in combination the steps of:

providing a baffle for each adjacent pair of finned tubes;

providing a first flow path for second fluid in between baffles at one of said finned tubes;

providing a second flow path for second fluid in between baffles at an adjacent other of said finned tubes;

making said second flow path larger between baffles at said other finned tube than said first flow path between baffles at said one finned tube; and making said second flow path longer along baffles at said other finned tube than said first flow path along baffles at said one finned tube.

2. A method as in claim 1, including the steps of:

providing each baffle with a first section at said one finned tube, and with a second section at said other finned tube, with said second section being made longer in said second flow path than said first section in said first flow path; and spacing second sections of baffles at said other finned tube further apart from each other than first sections of baffles at said one finned tube.

3. A method as in claim 1, wherein:

said finned tubes are staggered with respect to each other; and part of said second flow path extends along an outer part of said one finned tube and hence along said other finned tube.

4. A method as in claim 3, including the steps of:

providing each baffle with a first section at said one finned tube, and with a second section at said other finned tube, with said second section being made longer in said second flow path than said first section in said first flow path; and spacing second sections of baffles at said other finned tube further apart from each other than first sections of baffles at said one finned tube.

5. A method as in claim 1, wherein:

each of said finned tubes has heat-exchange fins extending thereabout and spaced therealong;

said first flow path also extends in between fins about said one finned tube; and said second flow path also extends in between fins about said other finned tube.

6. A method as in claim 5, wherein:

said finned tubes are staggered with respect to each other; and part of said second flow path extends also in between fins about said one finned tube and hence in between fins about said other finned tube.

7. A method of providing a baffle for an adjacent pair of elongate finned tubes of a heat exchanger, wherein each of said tubes has an annular heat-exchange fin structure thereabout, comprising in combination the steps of:

providing said baffle with two elongate sections at an obtuse angle for accommodating one of said heat-exchange fin structures; and providing said baffle with a third elongate section at an acute angle to one of said two elongate sections for accommodating the heat-exchange fin structures of both of said pair of elongate finned tubes at said acute angle.

8. A method as in claim 7, wherein:

a third elongate finned tube having a third annular heat-exchange fin structure thereabout is adjacent a first one of said pair of elongate finned tubes;

a second baffle is provided with fourth and fifth elongate sections at an obtuse angle for accommodating said third heat-exchange fin structure; and said second baffle is provided with a sixth elongate section at an acute angle to said fifth elongate section for accommodating said one of said pair of elongate finned tubes and said third annular heat-exchange fin structure, with said sixth elongate section being spaced from said third elongate section.

9. A method as in claim 8, wherein:

a fourth elongate finned tube having a fourth annular heat-exchange fin structure thereabout is adjacent said third elongate finned tube;

a third baffle is provided with seventh and eighth elongate sections at an obtuse angle for accommodating said third heat-exchange fin structure; and said third baffle is provided with a ninth elongate section at an acute angle to said eighth elongate section for accommodating said third and fourth annular heat exchange fin structures, with said seventh elongate section being spaced from said fourth elongate section.

10. A method as in claim 9, wherein:

said seventh elongate section is spaced from said fourth elongate section more than said sixth elongate section is spaced from said third elongate section.

11. A heat exchanger including a plurality of adjacent finned tubes, wherein a first fluid flows in said finned tubes and a second fluid of a different temperature flows past said finned tubes in heat transfer relationship therewith, comprising in combination:

a baffle for each adjacent pair of finned tubes;

a first flow path for second fluid in between baffles at one of said finned tubes; and a second flow path for second fluid in between baffles at an adjacent other of said finned tubes;

said second flow path being larger between baffles at said other finned tube than said first flow path between baffles at said one finned tube; and said second flow path being longer along baffles at said other finned tube than said first flow path along baffles at said one finned tube.

12. A heat exchanger as in claim 11, wherein:

each baffle has a first section at said one finned tube, and a second section at said other finned tube, with said second section being longer in said second flow path than said first section in said first flow path; and second sections of baffles at said other finned tube spaced further apart from each other than first sections of baffles at said one finned tube.

13. A heat exchanger as in claim 11, including:

said finned tubes staggered with respect to each other; and part of said second flow path extending along an outer part of said one finned tube and hence along said other finned tube.

14. A heat exchanger as in claim 13, wherein:

each baffle has a first section at said one finned tube, and a second section at said other finned tube, with said second section being longer in said second flow path than said first section in said first flow path; and second sections of baffles at said other finned tube spaced further apart from each other than first sections of baffles at said one finned tube.

15. A heat exchanger as in claim 11, wherein:

each of said finned tubes has heat-exchange fins extending thereabout and spaced therealong;

said first flow path also extends in between fins about said one finned tube; and said second flow path also extends in between fins about said other finned tube.

16. A heat exchanger as in claim 15, including:

said finned tubes staggered with respect to each other; and part of said second flow path extending also in between fins about said one finned tube and hence in between fins about said other finned tube.

17. A heat exchanger including a baffle for an adjacent pair of elongate finned tubes of the heat exchanger, wherein each of said tubes has an annular heat-exchange fin structure thereabout, comprising in combination:

two elongate sections extending at an obtuse angle to each other so as to accommodate one of said heat-exchange fin structures; and a third elongate section extending at an acute angle to one of said two elongate sections so as to accommodate the heat-exchange fin structures of both of said pair of elongate finned tubes.

18. A heat exchanger baffle as in claim 17, wherein:

an elongate third elongate finned tube having a third annular heat-exchange fin structure thereabout is adjacent a first one of said pair of elongate finned tubes;

a second baffle has fourth and fifth elongate sections at an obtuse angle so as to accommodate said third heat-exchange fin structure; and said second baffle has a sixth elongate section at an acute angle to said fifth elongate section so as to accommodate said one of said pair of elongate finned tubes and said third annular heat-exchange fin structure, with said sixth elongate section spaced from said third elongate section.

19. A heat exchanger baffle as in claim 18, wherein:

an elongate fourth elongate finned tube having a fourth annular heat-exchange fin structure thereabout is adjacent said third elongate finned tube;

a third baffle has seventh and eighth elongate sections at an obtuse angle so as to accommodate said third heat-exchange fin structure; and said third baffle has a ninth elongate section at an acute angle to said eighth elongate section so as to accommodate said third and fourth annular heat exchange fin structures, with said seventh elongate section spaced from said fourth elongate section.

20. A heat exchanger baffle as in claim 19, having:

said seventh elongate section spaced from said fourth elongate section more than said sixth elongate section is spaced from said third elongate section.

* * * * *